US005651392A

United States Patent [19]

Essirard

[11] Patent Number: 5,651,392

[45] Date of Patent: Jul. 29, 1997

[54] STATIC MULTI-STAGE FLUID-SPEED MULTIPLIER

[76] Inventor: Rene Essirard, St. Solen-Lanvallag, Dinan, France

[21] Appl. No.: 602,823

[22] PCT Filed: Jun. 8, 1995

[86] PCT No.: PCT/FR95/00747

§ 371 Date: May 13, 1996

§ 102(e) Date: May 13, 1996

[87] PCT Pub. No.: WO95/34760

PCT Pub. Date: Dec. 21, 1995

[30] Foreign Application Priority Data

Jun. 15, 1994 [FR] France ..... 94 07412

[51] Int. Cl.[6] ..... F15C 1/16

[52] U.S. Cl. ..... 137/809; 137/810; 137/811

[58] Field of Search ..... 137/809, 810, 137/811, 808

[56] References Cited

U.S. PATENT DOCUMENTS

| | | | |
|---|---|---|---|
| 3,461,897 | 8/1969 | Kwok | 137/809 |
| 5,076,327 | 12/1991 | Mettner | 137/809 |
| 5,303,782 | 4/1994 | Johannessen | 137/811 |

*Primary Examiner*—A. Michael Chambers
*Attorney, Agent, or Firm*—Jones & Askew, LLP

[57] ABSTRACT

Static assembly for increasing speed of a fluid jet. The assembly includes a series of fluid deflectors or obstacles, each having an edge over which the jet flows while accelerating. Respective surfaces connect the accelerated flow to the next successive deflector or obstacle, where the acceleration phenomenon repeats. Each deflector or obstacle preferably includes a hollow shape which the jet impacts. The width of the fluid jet decreases in proportion to the speed of the jet.

6 Claims, 2 Drawing Sheets

STATIC MULTI-STAGE FLUID-SPEED MULTIPLIER

This invention enables the speed of a fluid to be increased without the use of movable mechanical elements, which is advantageous in many applications, particularly when the speed of the fluid is limited.

It is known that a fluid moving at a speed V and striking an obstacle AB of $C_x$ greater than one experiences an increase in speed, starting from the last edge struck (A—FIG. 1), according to the formula: resultant or escape speed=upstream speed$\times\sqrt{C_x}$ $$V_r = V_a \times \sqrt{C_x}$$

The greatest increase in speed is achieved with a hollow, semi-circular obstacle (FIG. 2) of $C_x$=2.3, which is the greatest known.

If this operation could be repeated, as in electronic amplifiers, the performance or the precision of equipment using the energy of fluids would be greatly improved.

Figure 1:
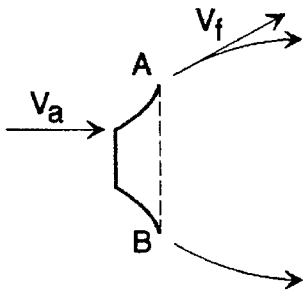
FIG. 1 is a schematic flow diagram illustrating a principle of fluid flow relevant to the present invention.
Figure 2:
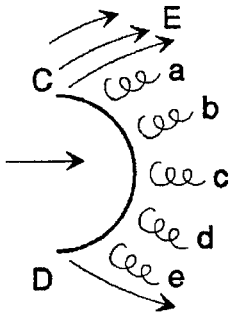
FIG. 2 is a schematic flow diagram illustrating a refinement to the principle shown in FIG. 1.
Figure 3:
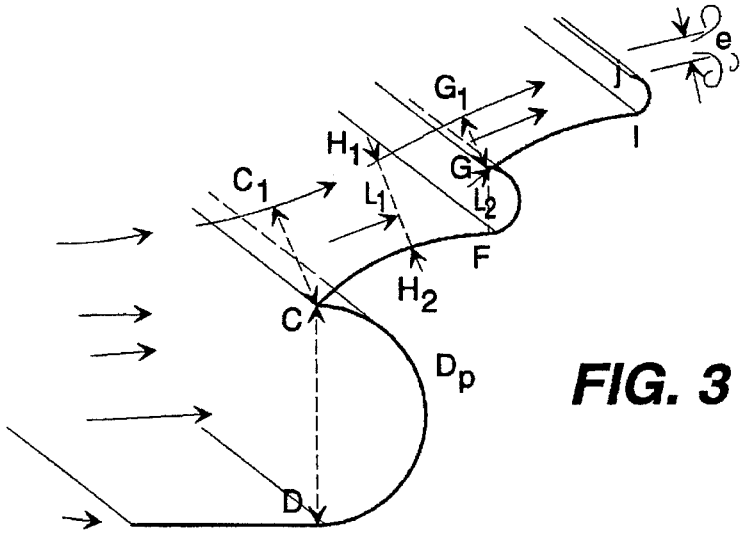
FIG. 3 is a schematic flow diagram illustrating a preferred embodiment of the present invention.

This profile across the fluid current can be considered as a speed amplifier of coefficient $K=\sqrt{C_x}$, at least for the region CE (FIG. 2) which borders the low-pressure wake (abcde—FIG. 2). Another obstacle (FG—FIG. 3) may be placed across the accelerated jet ($H_1H_2$—FIG. 3) so as to achieve a further acceleration of the fluid leaving FG (FIG. 3). For this purpose, the obstacle FG must intercept the accelerated jet $H_1H_2$ (FIG. 3) over a width $L_2$ less than the starting width ($L_1$) and FG must be connected to CD by a wall CF (FIG. 3) in order for the acceleration phenomenon to be reproduced, the width of the jet accelerated for a second time decreasing in proportion to its speed.

The increase in the speed of the fluid brings about, behind the obstacle, a low pressure $D_P$ (FIG. 3) which is proportional to $V^2_2$ (2° §) and hence to $C_x$ since $$\text{drag} = C_x\rho\frac{V^2}{2}$$

at each new obstacle responding to the conditions of position and dimensions given above (lines 22 to 26).

There is a moment at which the increase in speed of the fluid is such that the thickness (e—FIG. 3) of the jet becomes insufficient, the jet being transformed into ineffective eddies.

APPLICATIONS

Figure 4:
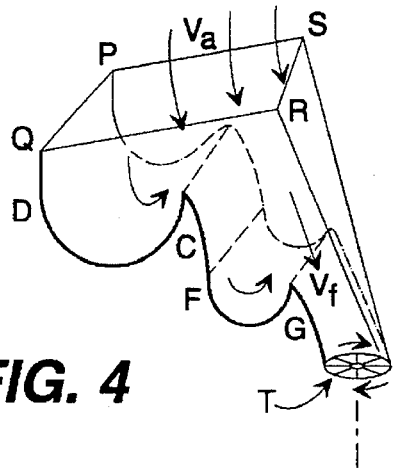
FIG. 4 is a pictorial view of a fluid-speed multiplier according to a preferred embodiment of the present invention.

1) The multiplication of the speed of the fluid greatly increases the power of a machine (T') using this fluid, for a given dimension (FIG. 4), such as an aeraulic turbine, for example.

Figure 5:
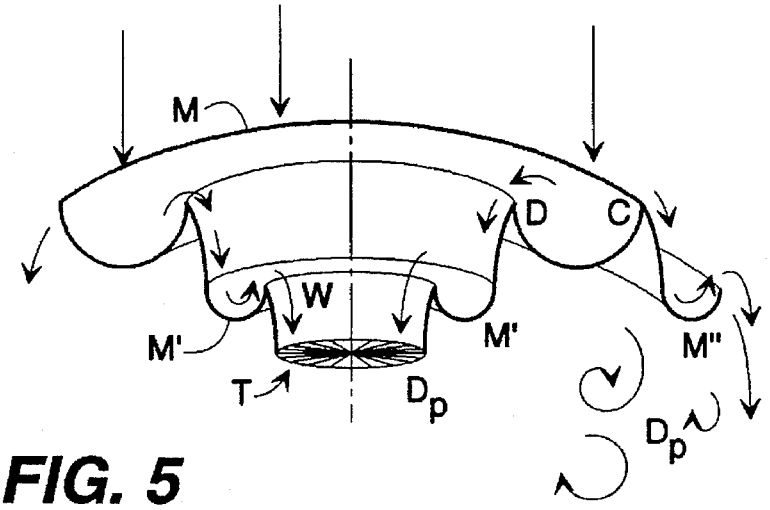
FIG. 5 is a pictorial view showing a fluid-speed multiplier according to another preferred embodiment of the present invention.

2) If this multiplier obstacle is developed in a ring around a turbine (T), for example, (section of FIG. 5) the speed of the accelerated fluid will give even more power.

3) If the multiplier obstacles M' and M" (FIG. 5) are placed on both sides of the main obstacle DC, also in a rings, the low pressure $D_P$ behind the assembly, and hence also the power developed by the turbine (T), will increase even further.

Figure 6:
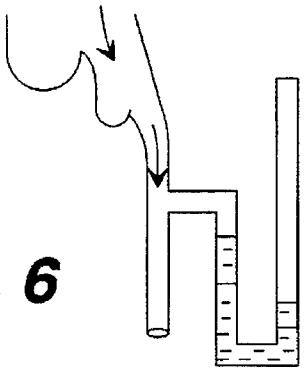
FIG. 6 is a schematic view showing a preferred embodiment of the present invention in use with a vacuum gauge.

4) The operation of vacuum gauges and fluid meters is greatly improved by virtue of the greater vacuum which increases the sensitivity of the devices (FIG. 6) and allows them to be made more robust.

5) Pneumatic and hydraulic transmission. The increase in the speed of fluids at the end of their paths prevents or partially compensates for losses of head in pipes, both for measurements and for remote control and power transfer.

6) Scouring or drilling guns in surface working with pure fluids or loaded fluids, the impact of which is reinforced.

7) Mining and underground drilling HEADS of all kinds.

EXAMPLE OF APPLICATION

Compressed-air securing gun

Figure 7:
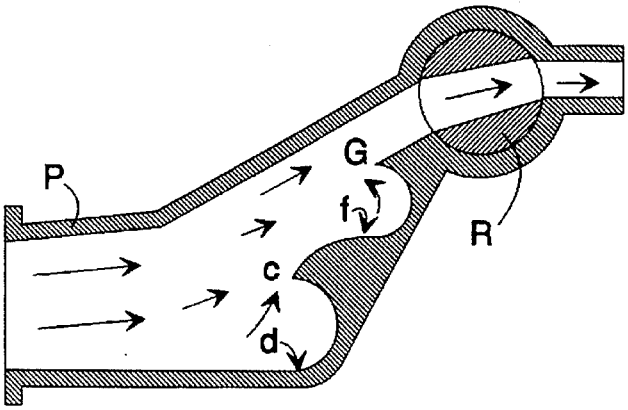
FIG. 7 is a sectioned view of an air scouring gun embodying the present invention.

A pipe of rectangular cross-section PQRS (FIG. 7) is closed at its end by a thick metal band with a profile according to the sketch DCFG, responding to the conditions of lines 22 to 26, page 1. With pure air and two semi-circular obstacles, the air speed will be multiplied by $(\sqrt{C_x})^2$, that is, $1.5^2$=2.3 and the impact by $2.3^2$, that is, 5.29.

I claim:

1. A static multi-stage speed multiplier for increasing the speed of a fluid jet flowing in a certain path and having a width, the multiplier comprising:

successive fixed obstacles each of hollow shape and having an acute edge respectively connected by a surface to an adjacent such obstacle; and the obstacles positioned in relation to the path of the fluid jet so that the fluid jet strikes the hollow shape of each successive obstacle in turn and flows from each respective acute edge and along the surface to strike a downstream obstacle, whereby the speed of the jet accelerates in response to striking each successive obstacle and the width of the jet decreases in proportion to the speed of the jet.

2. The device according to claim 1 characterized in that the successive obstacles are of a decreasing width in the direction of the flow of the fluid jet.

3. The device according to claim 1 characterized in that the obstacles are of a semi-circular shape whereof the hollow is turned to the upstream in the direction of the flow of the fluid jet.

4. The device according to claim 3, characterized in that the obstacles are of a right circular semi-cylindrical shape.

5. The device according to claim 3, characterized in that the obstacles are of a ring with a semi-circular section form.

6. The device according to claim 5, characterized in that the obstacles are around a receiver device placed directly downstream from the last obstacle in the direction of the flow of the fluid jet so as to receive the accelerated fluid jet.

* * * * *